US009534411B2

(12) United States Patent
Kurosawa

(10) Patent No.: US 9,534,411 B2
(45) Date of Patent: Jan. 3, 2017

(54) EARTHQUAKE RESISTING DESIGN METHOD ON THE BASIS OF PC BINDING ARTICULATION CONSTRUCTION METHOD

(71) Applicant: Kurosawa Construction Co., Ltd., Tokyo (JP)

(72) Inventor: Ryohei Kurosawa, Tokyo (JP)

(73) Assignee: KUROSAWA CONSTRUCTION CO., LTD., Tokyo (JP)

( * ) Notice: Subject to any disclaimer, the term of this patent is extended or adjusted under 35 U.S.C. 154(b) by 0 days.

(21) Appl. No.: 14/710,901

(22) Filed: May 13, 2015

(65) Prior Publication Data

US 2015/0330095 A1 Nov. 19, 2015

(30) Foreign Application Priority Data

May 16, 2014 (JP) ..... 2014-102167

(51) Int. Cl.

| | |
|---|---|
| ***E04B 1/98*** | (2006.01) |
| ***E04H 9/02*** | (2006.01) |
| ***E04H 12/16*** | (2006.01) |
| ***E04C 3/34*** | (2006.01) |
| ***E04C 5/01*** | (2006.01) |
| *E04B 1/22* | (2006.01) |

(52) U.S. Cl.

CPC ..... *E04H 9/021* (2013.01); *E04B 1/98* (2013.01); *E04C 3/34* (2013.01); *E04C 5/012* (2013.01); *E04H 9/02* (2013.01); *E04H 9/025* (2013.01); *E04H 12/16* (2013.01); *E04B 1/22* (2013.01)

(58) Field of Classification Search

CPC ..... E04H 9/021; E04H 9/02; E04H 9/025; E04H 12/16; E04B 1/98; E04B 1/22; E04C 3/34; E04C 5/012

USPC ..... 52/741.3, 167.1, 223.4, 223.1, 223.14

See application file for complete search history.

(56) References Cited

FOREIGN PATENT DOCUMENTS

| | | |
|---|---|---|
| JP | 7-042727 | 5/1995 |
| JP | 10-046663 | 2/1998 |
| JP | 11-172762 | 6/1999 |
| JP | 2000-220210 | 8/2000 |
| JP | 2002-004417 | 1/2002 |
| JP | 2002-004418 | 1/2002 |

(Continued)

OTHER PUBLICATIONS

Japanese Notice of Reasons for Refusal issued Aug. 8, 2014 in Japanese Patent Application No. 2014-102167 with English translation.

*Primary Examiner* — Chi Q Nguyen

(74) *Attorney, Agent, or Firm* — Wenderoth, Lind & Ponack, L.L.P.

(57) ABSTRACT

In an earthquake resisting design method of a PC construction, a column and a beam, which are high-strength precast prestress concrete members, are joined by binding juncture with a prestressing tendon. A grout is filled and bonded. A first stage linear resilient design is employed, where all construction members are not damaged, for earthquakes up to a predetermined earthquake load design value. A second stage linear resilient design is employed, where earthquake energy is absorbed by breakage of the bond of the grout, and principal construction members are not damaged, for earthquakes exceeding the predetermined earthquake load design value. By employing a non-linear resilient design in which the first stage linear resilient design and the second stage linear resilient design are combined, an earthquake-resisting design level is significantly increased, and the construction can resist earthquakes exceeding a seismic intensity 6 upper.

8 Claims, 5 Drawing Sheets

(56) References Cited

FOREIGN PATENT DOCUMENTS

| | | |
|---|---|---|
| JP | 2003-013496 | 1/2003 |
| JP | 2005-171643 | 6/2005 |
| JP | 2011-196089 | 10/2011 |

Fig. 7A
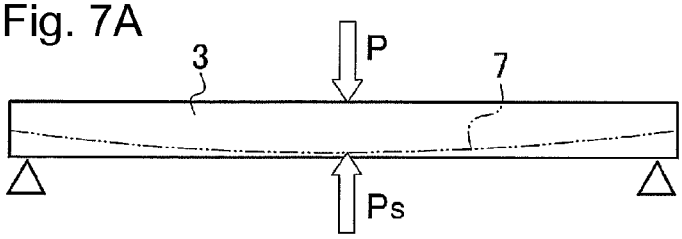
Fig. 7B
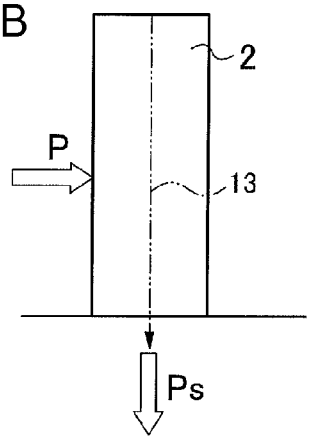
Fig. 7C
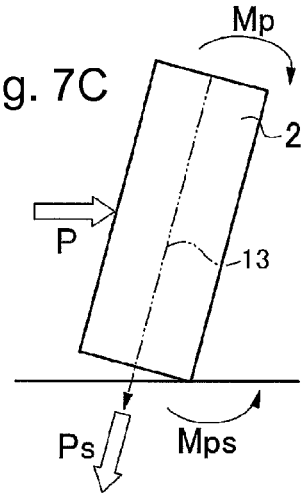
Fig. 8A
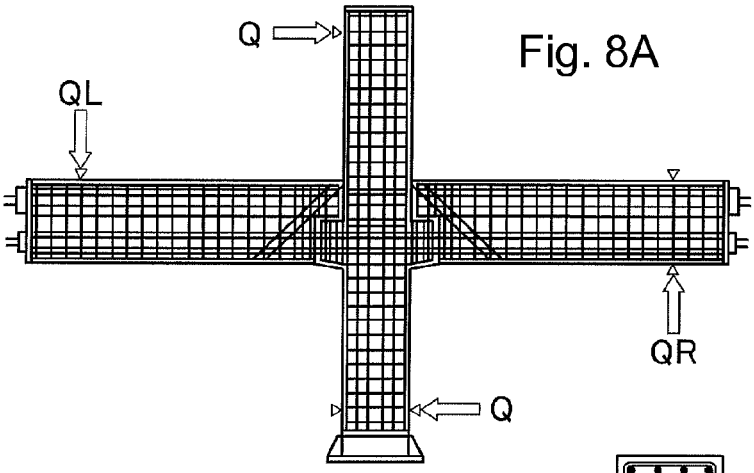
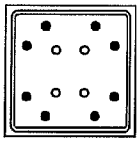
Fig. 8B
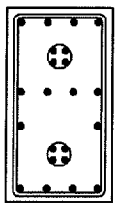
Fig. 8C

EARTHQUAKE RESISTING DESIGN METHOD ON THE BASIS OF PC BINDING ARTICULATION CONSTRUCTION METHOD

BACKGROUND OF THE INVENTION

1. Field of the Invention

The present invention relates to an earthquake resisting design method of a prestressed concrete construction (hereinafter, referred to as "PC construction"). The PC construction of the present invention is defined to indicate a configuration in which high-strength precast prestressed concrete (PCaPC) members (column, beam) are joined by PC binding juncture with a prestressing tendon.

2. Description of the Related Art

A reinforced concrete construction (RC construction) of the related art, being inexpensive, highly rigid and superior in occupant comfort, is used in buildings such as collective housing and offices in many cases.

In contrast, a prestressed concrete construction (PC construction) is configured to resist an envisioned load by applying a prestress to a cross section of a concrete member in advance so as to be applied to buildings having a large span beam or beams and columns that support a heavy load. Since having high restorability in comparison with RC construction, it can maintain a required goodness after earthquakes.

A plurality of technologies (patents) are known about the PC construction. A first known technology is a connecting structure between a column and a beam, which have a junction between a precast concrete column and a precast concrete beam. It is characterized in that a junction having a cross section protruding from a side surface of the beam and a bottom surface of the beam is provided at an end of the beam, coupling reinforcement rods configured to couple the beam and the column are disposed on a lower portion of the beam and an upper portion of the beam of the junction, and a prestressing tendon is arrayed at a position nearer to a neutral shaft of a cross section of the beam than these coupling reinforcement rods, thereby coupling the beam and the column (JP07-042727B).

In this connecting structure between the column and the beam, the coupling reinforcement rods are disposed on the upper and lower portions of a height of the beam at the coupling portion, and the prestressing tendon for introducing the prestress is arranged at positions near the neutral axis of the cross section, so that the upper and lower reinforcement rods at the connection bear a large deformation caused by a load at the time of earthquakes to absorb large deformation energy. It is said that the prestressing tendon, which performs mainly a binding functions at the junction between the column and the beam, is subjected to a smaller deformation than the reinforcement rods, damage at the time of earthquake is small, and safeness is achieved.

A second known technology is a PC binding juncture construction between a precast concrete beam and column which is a construction in which an unbonded prestressing tendon is utilized for introducing a prestress, and a precast concrete beam is joined to a precast concrete column by binding juncture. It is characterized in that a resilient member, configured to prevent crush of concrete at an end of the beam by absorbing a compress deformation, is installed on a side surface of the column at a portion subjected to compression by a rotational deformation caused by lifting of the beam (JP2002-004417A).

It is said that the PC binding juncture construction between a precast concrete beam and column contributes to architecture of an RC system building in which a rigid frame body is not damaged even by the large earthquake which is considered to occur once in a hundred years, or damage can be repaired by replacing an impact material.

A third known technology is a self-seismic isolation construction method for an RC system construction in which an unbonded prestressing tendon is utilized for introducing a prestress, and a precast concrete beam is joined to a precast concrete column by binding juncture. The self-seismic isolation construction method for the RC system construction is characterized in that the unbonded prestressing tendon is penetrated through the precast concrete beam in a longitudinal direction, both end portions of the unbonded prestressing tendon are fixed to the precast concrete column, so as to achieve a configuration which allows lifting of a column-beam juncture interface in association with a resilient expansion deformation of the unbonded prestressing tendon in accordance with a horizontal force of an earthquake or the like (JP2002-004418A).

It is said that according to the self-seismic isolation construction method for the RC system construction, an own natural period of the RC system construction may be elongated without using a seismic isolation apparatus and a vibration control apparatus. It is also said that since the seismic isolation apparatus and the vibration control apparatus, and also maintenance in association therewith are not necessary, it contributes considerably to cost reduction, and is superior in occupant comfort.

Furthermore, a fourth known technology is an earthquake resisting structure built by a PC binding construction method. The earthquake resisting structure by the PC binding construction method is characterized in that a body frame, having a beam and columns at both ends thereof as a minimum unit, has junctions between the beam and the columns configured as rotatable junctions, which bears mainly a perpendicular load, and is constructed by binding juncture in which a prestress is introduced into an unbonded type prestressing tendon penetrated through the beam in the axial direction and also through the columns. A horizontal resistance member, configured to absorb energy by yielding before the body frame becomes damaged at the time of earthquake, is affixed to a side surface portion of the body frame, and it is a plate member having a length to straddle the rotatable junctions at the both ends of the beam. Both side positions of the rotatable junctions are coupled thereto by the binding juncture in which the prestress is introduced into the prestressing tendon (JP2005-171643A).

Since this earthquake resisting structure by the PC binding construction method has a configuration in which the columns and the beam of the body frame are joined by binding juncture in which the prestress is introduced into the long unbonded type prestressing tendon, which mainly bears a perpendicular load, distortion of the prestressing tendon is averaged over the entire length. Therefore, distortion of the prestressing tendon falls within the range of the resilient limit even at the time of great deformation, and structural safety is high. It is said that the body frame can easily follow the great deformation at the time of earthquake, and after the earthquake has gone, restoration is performed as an effective advantage of the prestress introduced into the prestressing tendon, so that a residual deformation is restored to zero.

It is said that in the first known technology, the reinforcement rods disposed in upper and lower portions of the beam bear a large deformation caused by a load at the time of an earthquake, and absorb large deformation energy; the prestressing tendon, which introduces the prestress and which is arranged at a position near a neutral axis of the junction between the column and the beam, is subjected to a smaller deformation than the reinforcement rods, damage at the time of the earthquake is small, and safeness is achieved. However, this has a problem that energy is absorbed by a plastic deformation of the reinforcement rods in the same manner as the RC design of the related art, and hence the residual deformation of the reinforcement rods after the earthquake is large, and cannot be repaired.

The second known technology provides a configuration in which the resilient member, configured to prevent crush of concrete at the end of the beam, is provided on the side surface of the column at a portion subjected to compression by the rotational deformation caused by lifting of the beam. However, it is apparent that providing a plurality of notched depressions for mounting the resilient members on a plurality of side surfaces of the column at the same level makes loss of cross section of the column itself, and thereby reduces significantly the strength thereof. And this has a problem that because of lack of a member configured to support the end portion of the beam, repeated earthquake forces cause downward slippage at the junction to the column, which may easily cause fracture of the unbonded prestressing tendon itself and breakage of a binding junction between the beam and the column, and thereby produces a very high risk of destruction of the construction.

It is said that in the third known technology, the unbonded prestressing tendon is penetrated through the precast concrete beam in the longitudinal direction, the both end portions thereof are fixed to the precast concrete columns, so as to allow lifting of the column-beam juncture interface in association with the resilient expansion deformation of the unbonded prestressing tendon in association with the horizontal force of the earthquake or the like. However, this has a problem that the fixation of the unbonded prestressing tendon in this case is 80% of a standard yield load of the prestressing tendon from the description saying "not specifically new, and is implemented by a method described in a PC standard of Architectural Societies," in the same manner of the second known technology, repeated earthquake forces cause downward slippage at the junction to the column because there is no member configured to support the end portion of the beam, and thereby there is a very high risk of destruction of the construction caused by the fracture of the prestressing tendon.

In the fourth known technology, the horizontal resistance member, configured to absorb energy by yielding before the body frame becomes damaged at the time of the earthquake, is affixed to the side surface portion of the body frame, and it is the plate member having a length to straddle the rotatable junctions at the both ends of the beam, and the both side positions of the rotatable junctions are coupled thereto by the binding juncture in which the prestress is introduced into the prestressing tendon. It is said that consequently, damage is encouraged to be concentrated on the horizontal resistance member, to cause plastic deformation therein, absorption of earthquake energy, reduction of response, and thereby realization of debilitating effect. However, it is still the plastic design as conventional, and hence the plastically deformed horizontal resistance member cannot be repaired. Therefore, all the horizontal resistance members need to be replaced after the earthquake, which requires troublesome task in field work, so that there is a problem of significant increase in cost.

As a common problem in the second to the fourth known technologies, grease used as a filler of the unbonded prestressing tendon is subjected to an oil separation phenomenon with time, which significantly impairs corrosion control performance. Therefore, it is not preferable to use the unbonded prestressing tendon in the PC binding juncture structure between the column and the beam.

A current earthquake resisting design standard in Japan allows damage of a structure with a seismic intensity 5 upper or so, and allows even a collapse as long as design ensures safety of human life. There is a report saying that many damages occurred at the time of a huge earthquake exceeding a seismic intensity 6, such that buildings of the RC structure, the S structure, and the SRC structure were collapsed or significantly deformed (plastic deformation of an inter-story deflection angle of 1/100 or larger) and broken, and that the residual deformation remains after the earthquake and cannot be repaired.

The term "seismic intensity" is an index indicating degree of shaking of the earthquake at a certain point, and indicates earthquake scales used by Japan Meteorological Agency (Japan meteorological Agency seismic intensity scale).

In particular, Japan is a country having often earthquakes, and has a soil which can be subjected to a great earthquake disaster any time. A current design method for constructing buildings of RC structure or S structure is "plastic design," wherein the reinforcement rods and steel frames are designed to be used as far as in plastic region at the time of earthquake. On such a soil, this is not a design method suitable for this state of country. In addition, buildings designed on the basis of a theory of absorbing energy by a plastic deformation, which is a basic of the reinforcement rods construction, absorb energy of earthquake by a plastic deformation of a panel zone. Consequently, there is a problem that the panel zone is subjected to a shear failure, and damage and residual deformation caused by the earthquake are severe and hence restoration is impossible after the earthquake has gone. In a word, in the RC rigid frame structure of the design method of the related art, the destruction at the time of the large earthquake occurs certainly in the panel zone (column-beam junction), and hence the entire construction is destructed in a manner that the column is destructed in first by the shear failure in the panel zone.

In any cases, in the PC construction of the related art, a tension introducing force of the prestressing tendon arranged on a cross section of a member is designed to be 80% of the standard yield load (Py) of the prestressing tendon at the time of completion of the fixation. The current earthquake resisting design method against the earthquake allows yield of the prestressing tendon under the maximum design load in the same manner as the RC construction. Consequently, since there is no sufficient available capacity preserved in the prestressing tendon under permanent load, the prestressing tendon yields and is plastically deformed at the maximum design value, so that a loss of superior restorability of the PC construction is accompanied. Then, the force of restoring the deformation of the construction members vanished and, after the earthquake has gone, residual deformation remains. Therefore, generated cracks cannot be closed, and the cracks progress larger with passing of time. This affects a construction frame negatively, whereby a lifetime of usage is significantly reduced.

Since the "plastic design," wherein deformation of the panel zone is allowed for absorbing earthquake energy, is used in the same manner as the RC construction or the like, the shear failure in the panel zone (column-beam junction) cannot be avoided at the time of a large earthquake. In addition, at the time of the huge earthquake with a seismic intensity 6 or greater, which exceeds an earthquake resisting design level, since a cogging for supporting the beam is not provided at the binding junction between the column and the beam, the beam slips downward and the prestressing tendon is subjected to precedence fracture, and a shear failure of the beam occurs together with the breakage of the construction members, so that there is a risk of collapse of the building. There is also a problem that a surface area of a loop of a load deformation curve is smaller than that of the RC construction, energy consumption by the plastic deformation of the construction is smaller in the historical characteristics, and hence it is said not to be a desirable nature against the large earthquake.

SUMMARY OF THE INVENTION

In order to solve various problems in an earthquake resisting performance relating to the PC construction, the present inventor has been worked in research and development for a long time in order to produce buildings superior in earthquake resisting performance since 1987, and established a PC binding articulation construction method verified by various experiments on the basis of an idea of the present inventor.

The building superior in the earthquake resisting performance that the present inventor aims is based on a basic premise that principal construction members are not damaged at the time of a large earthquake. In addition, it means the construction which can maintain a good condition, even after the large earthquake has gone, against afterquakes and the like occurring thereafter, and can be continuously used without impairing the function as a building.

It is an object of the present invention to provide an earthquake resisting design method for a PC construction (hereinafter, referred to as the present design method) on the basis of a new PC binding articulation construction method based on a resilient design even against a maximum earthquake exceeding a seismic intensity 6 upper.

As a detailed means for achieving the above-described object, a first aspect of the present invention provides an earthquake resisting design method for a PC construction on the basis of a PC binding articulation construction method. The PC construction is a building having a rigid frame structure, and having a foundation, a column, and a beam. The column and the beam are high-strength precast prestressed concrete members. A cogging is provided at a column-beam junction of the column (a panel zone). The beam is placed on the cogging. A binding joint portion is provided between the column and the beam. A secondary prestressing tendon (a secondary cable) is provided to penetrate through the beam and the column-beam junction. The secondary prestressing tendon is tensed, and thereby the column and the beam are integrally joined by binding juncture. A grout is bonded to the secondary prestressing tendon, and thereby fixing it. The earthquake resisting design method includes designing bond between the secondary prestressing tendon and the grout to be broken within a vicinity of the binding joint portion when a load exceeds a predetermined earthquake load design value. Thereby, when an earthquake occurs in which the load does not exceed the earthquake load design value, the binding joint portion remains in a state of full prestress, and the column, the beam, and the secondary prestressing tendon are deformed within a linear resilient range, and not damaged. When an earthquake occurs in which the load exceeds the earthquake load design value, the bond between the secondary prestressing tendon and the grout is broken, thereby the binding joint portion becomes in a state of partial prestress. The binding joint portion opens or separates, and becomes rotatable, the secondary prestressing tendon comes out, increases an amount of expansion of the secondary prestressing tendon, and thereby absorbs earthquake energy within a resilient range of the secondary prestressing tendon, and the column, the beam, and the secondary prestressing tendon are deformed within the linear resilient range, and not damaged. As a whole, the PC construction is designed by a non-linear resilient design combined a first stage linear resilient design in the case of the load not exceeding the earthquake load design value and a second stage linear resilient design in the case of the load exceeding the earthquake load design value.

The earthquake load design value may be a load corresponding to an earthquake with a seismic intensity 6 lower. A tensioning force of the secondary prestressing tendon may be 40% to 60% of a standard yield load of the secondary prestressing tendon. In the PC construction, a second binding joint portion may be provided between the foundation and a column base of the column. A second secondary prestressing tendon may be provided to penetrate through the foundation and the column base. The second secondary prestressing tendon may be tensed, and thereby the foundation and the column may be integrally joined by binding juncture. A second grout may be bonded to the second secondary prestressing tendon, and thereby fixing it. The earthquake resisting design method may include designing a bond between the second secondary prestressing tendon and the second grout to be broken when a load exceeds a predetermined second earthquake load design value. Thereby, when an earthquake occurs in which the load does not exceed the second earthquake load design value, the second binding joint portion remains in a state of full prestress, and the column and the second secondary prestressing tendon are deformed within a linear resilient range, and not damaged. When an earthquake occurs in which the load exceeds the second earthquake load design value, a bond between the second secondary prestressing tendon and the second grout is broken, thereby the second binding joint portion becomes in a state of partial prestress. The second binding joint portion opens, or separates, and becomes rotatable, and thereby the second secondary prestressing tendon absorbs earthquake energy within a resilient range of the second secondary prestressing tendon, and the column and the second secondary prestressing tendon are deformed within the linear resilient range, and not damaged. The column base may be a base block installed between the foundation and the column. A tensioning force of the second secondary prestressing tendon may be 40% to 60% of the standard yield load of the second secondary prestressing tendon. The PC construction may be a PC seismic isolation construction constructed by a seismic isolation construction method in combination.

A second aspect of the present invention is a building constructed by the earthquake resisting design method on the basis of the PC binding articulation construction method.

Advantages of the Invention

The earthquake resisting design method on the basis of the PC binding articulation construction method according to the present invention achieves the following superior effects.

1. All the construction members are not damaged against a load up to a predetermined design value.

Even when an earthquake with a seismic intensity 6 lower occurs, RC construction and SRC construction constructed by the design method of the related art are subjected to damage destruction by the occurrence of a plastic deformation. The restoration after the earthquake is almost impossible.

In contrast, a PC construction constructed by the present design method has a resistance force against a load of the design value (a prestress force and a PC tightening force of the column and beam resisting a change in member angle) applied as internal energy into the concrete members, such as the column and the beam. Thereby, the construction itself is resiliently deformed, a restoration force of the PC column reduces the deformation, the internal energy accumulated in the members absorbs earthquake energy, and thereby the state of full prestress is maintained. Therefore, even after the earthquake disaster, the building is in the good conditions and can be used continuously without losing functions as the building.

2. The damage destruction in a panel zone is avoided even against a load exceeding the predetermined design value.

The binding joint portion is designed to open (rotate) and become a state of partial prestress even in the case where an earthquake occurs in which a load exceeds the design value. In the area of partial prestress, increment in stress applied to the panel zone is reduced by the binding joint portion opening to separate and allow the rotation, so that no damage destruction of the panel zone occurs.

Experiments have confirm the following fact: when a load of the earthquake load design value is applied, the binding joint portion is deformed in the state of full prestress, and small cracks occur in upper and lower portions of the panel zone; when the load exceeds the design value, the binding joint portion becomes in the state of partial prestress, and opens, the column and the beam on the cogging separate and rotate, and the small cracks in the upper and lower portions of the panel zone closes inversely. This prevents any further cracks in the panel zone.

In the RC construction of the related art, a plastic deformation of the panel zone absorbs energy of the earthquake at the time of a large earthquake. As a result, the panel zone is subjected to shear failure, so that the structure results in collapse, which is a so-called column failure preceding type.

In contrast, in the column-beam binding junction of the PC construction according to the present design method, the binding joint portion does not separate against a load up to the predetermined earthquake load design value. However, at the time of the maximum earthquake in which the load exceeds the design value, the binding joint portion separates, so that the panel zone is prevented from shear failure. Consequently, principal construction members, such as column, beam, and panel zone, are not damaged. The building construction can be protected by the binding joint portion opening. When the earthquake has gone, a resilient restoration force of the secondary prestressing tendon makes the opening close, and makes the separated binding joint portion restored to the original state. The construction is in a good condition with no residual deformation. The binding joint portion, even when subjected to light damage, can be repaired for a continuous usage.

3. An input value is reduced at the time of the maximum earthquake.

When the maximum earthquake occurs in which the load exceeds the predetermined design value, the column-beam binding junction opens and allows rotation. The bond between the secondary prestressing tendon and the grout is brought into a broken state in the vicinity of the binding joint portion within a required length, and the secondary prestressing tendon comes out to increase an amount of expansion, and thereby absorbs the earthquake energy. A tensile force borne by the secondary prestressing tendon is not increased, so that the secondary prestressing tendon is maintained within the resilient range, and thereby the input value is reduced. In other words, when a maximum earthquake occurs in which the load exceeds the predetermined design value, a resilient deformation line of the secondary prestressing tendon becomes more horizontal, so that the input value can be reduced. In the binding junction, a tensioning force of the secondary prestressing tendon (the secondary cable) is controlled to be 50% or so (40% to 60% of Py) of the standard yield load (Py) of the secondary prestressing tendon. Therefore, even when a maximum earthquake occurs in which the load exceeds the predetermined design value, the secondary prestressing tendon has a sufficient available capacity, and maintains within a resilient range all the way. The secondary prestressing tendon works as a spring, and brings out a force resisting the deformation of the building due to the earthquake, and a prestress restoration force applied by the resilient resistance force of the secondary prestressing tendon works as a force to return the building to the original state. In a word, a vibration control effect is obtained by the prestress.

4. Damage of the column in the column base portion is avoided.

When a maximum earthquake occurs in which the load exceeds the predetermined design value, the binding joint portion under the column base (the second binding joint portion) opens, and becomes in a state of partial prestress. The binding joint portion opens while maintaining the secondary prestressing tendon within the resilient range, so that earthquake energy is absorbed. This eliminates a column damage destruction at the column base portion, which is the most important portion supporting the entire building. In the binding joint portion of the column base portion, the secondary prestressing tendon (the second secondary cable) is continuously maintained within a resilient range with no plastic deformation all the way. Therefore, the opening closes again by the PC restoration force, and the joint portion is restored to the original state after the earthquake, and thereby the building can be used continuously.

5. A building can be obtained, which have a seismic isolation and vibration control effect, and a cost reduction effect.

The PC seismic isolation construction, which is the PC construction by the present design method and the seismic isolation construction method in combination, is designed by a resilient design, and has an superstructure possessing the PC restoration force characteristics within a non-linear resilience region. This produces effects of earthquake resisting, seismic isolation, and also vibration control. The prestress introduced therein becomes a restoration force which makes an attempt to restore the building to the original state after the deformation caused by the earthquake, and brings out a vibration control effect.

In comparison with the RC construction, the cross section of the column and the beam of the superstructure may be reduced by 20% or so. This contributes to a cost reduction by slimming down.

In addition, in the case of the seismic isolation construction, it is necessary to increase a surface pressure in relation to the arrangement of an isolator, so that a supporting span needs to be increased. In the case that the superstructure is the rigid frame structure of the present design method, the supporting span can be increased, and there is no risk of cracking caused by a long-term load.

The restoration force of the introduced prestress can dramatically reduce an extent of shaking at the time of earthquake. The building is restored to the original state after the earthquake. Therefore, repeated shaking and deformation caused by the earthquake are restrained, and this achieves a superior vibration control effect. In a word, the seismic isolation effect and the vibration control effect by the prestress are obtained.

6. Slab cracking prevention effect is obtained.

In the RC construction and the like of the related art, shakings and vibrations caused by wind loads and medium and small earthquake loads, which arise constantly, make often a concrete slab crack and also suffer excessive flexural deformations. This produces a major obstacle in usability and durability of the building.

In contrast, the PC restoration force of the PC construction of the present design method can significantly improve rigidity. This restrains the shaking and vibration, which occur constantly, to a very small level, thereby preventing the slab from cracking Wiring the primary prestressing tendon (the primary cable) and the secondary prestressing tendon (the secondary cable) disposed in a precast beam member concentrically on a center cross section of the span can make the beam cambered upwards. This cancels out a flexural deformation caused by the load during the usage, thereby eliminating deformation which may be an obstacle during usage.

BRIEF DESCRIPTION OF THE DRAWINGS

FIG. 2A shows fishing rod theory, and FIG. 2B shows articulation theory;

FIG. 5A shows a state in which the secondary prestressing tendon is bonded and a tensioning force is introduced, FIG. 5B shows a state in which the bond is broken and expansion occurs in the secondary prestressing tendon;

FIGS. 7A to 7C are schematic drawings illustrating a vibration control effect of prestress forces (internal forces) introduced into construction members of the present design method, FIG. 7A shows the beam, and FIGS. 7B and 7C show the columns;

FIGS. 8A to 8C are drawings illustrating a crisscross frame used as an earthquake resistance test sample in a ⅓ scale of an actual size of a building of the present design method, FIG. 8A is a side view of the entirety, FIG. 8B is an enlarged cross-sectional view of the column, and FIG. 8C is an enlarged cross-sectional view of the beam;

DESCRIPTION OF THE PREFERRED EMBODIMENTS

An earthquake resisting design method on the basis of a PC binding articulation construction method according to the present invention will be described in detail, based on an illustrated embodiment.

Figure 1:
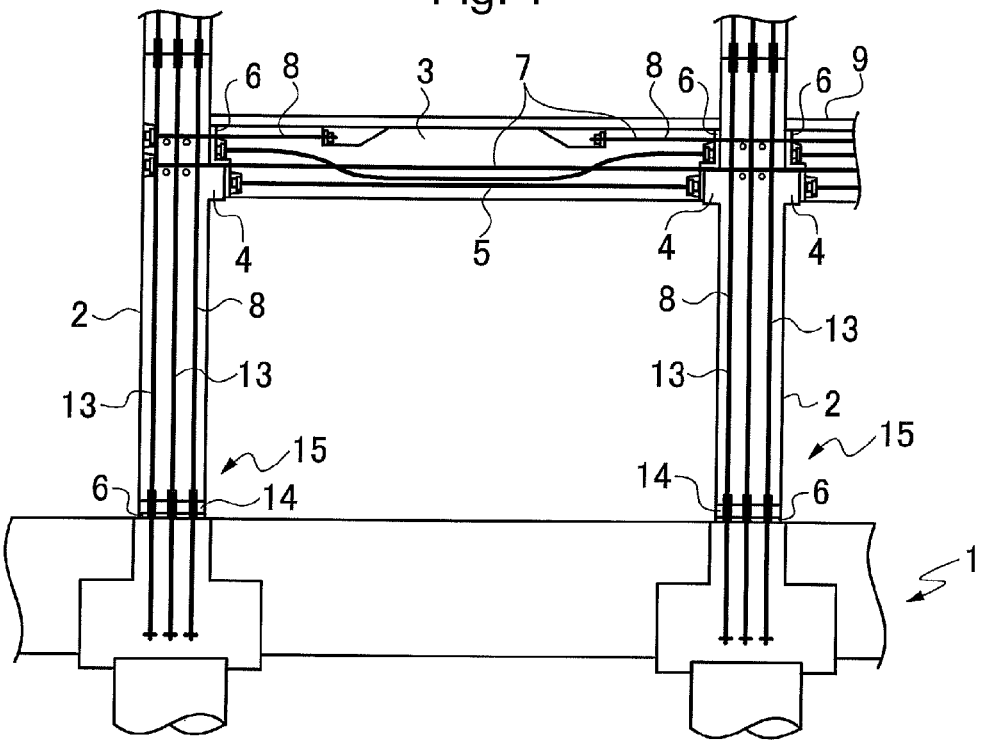
FIG. 1 is a side view of a representative PC building by application of an earthquake resisting design method of a PC construction on the basis of a PC binding articulation construction method of the present invention, illustrating a part of a wiring shape in cross section.

As illustrated in FIG. 1, a basic configuration of a building by the PC binding articulation construction method is a rigid frame structure including a foundation 1, columns 2, and beams 3. The columns 2 and the beams 3, which are construction members, are high-strength precast prestressed concrete members. A base block 14, to be worked as a column base, is installed between the foundation 1 and each of the columns 2 of the lowest stage. A binding joint 6 (a binding joint portion) is provided under the base block 14. A prestressing tendon 13 (a second secondary prestressing tendon) is disposed to penetrate through the foundation 1, the base block 14, and the column 2. The prestressing tendon 13 joins the foundation 1, the base block 14, and the column 2 integrally by binding juncture, and thereby a column base portion 15 is formed. That is, the base block 14 is arranged, as the column base of the column 2, at the column base portion 15. The column 3 is provided with coggings 4. The beam 3 is placed on the coggings 4. A prestress is introduced into the beam 3 by a prestressing tendon 5 (a primary prestressing tendon) disposed as a primary cable. The binding joint 6 is provided between the column 2 and the beam 3. A prestressing tendon 7 (a secondary prestressing tendon), disposed as secondary cables, joins the column 2 and the beam 3 by binding juncture. The prestressing tendon 5, which is the primary cable, is arranged against a long-term load. A tensioning force thereof is designed to be up to 80% of a standard yield load of the prestressing tendon at the time of completion of fixation with tension, as with a conventional way. A method of applying the prestress may be either one of a pre-tensioning system and a post-tensioning system (a type of fixation with tension at beam ends). Some of the primary cables 5 and the secondary cables 7, disposed in the beam 3, are disposed eccentrically at a central cross section of a span.

It is preferable to use the base blocks for achieving construction of precast columns safely and easily. However, there is no need to provide base blocks, contrary to the illustration.

The prestressing tendon 7, which is the secondary cable, is used for joining the column 2 and the beam 3 integrally by binding juncture. A tensioning force thereof is designed to be lower than a design value of a PC construction of the related art. The tensioning force at a binding joint portion is set to 50%±10% or so of the standard yield load of the prestressing tendon 7. A plurality of secondary prestressing tendons 13 are disposed for tension in the column 2 as well. At a panel zone (a column-beam junction), a prestress is applied to a great beam, which is a beam in a span direction, a girder beam, which is a beam in a longitudinal direction, and the column. Thereby the panel zone receives a prestress force three-dimensionally in all directions of X, Y, and Z. The prestressing tendons 7 and 13 are a bonded type, which are disposed through a sheath 8 disposed in advance, and a grout is filled therein after the fixation with tension. On an upper surface of the beam 3, a slab 9 is placed at each stage. Accordingly, the rigid frame structure having an articulation mechanism is constructed.

In stresses caused by an earthquake force in the rigid frame structure, the largest are ones generated at beam ends and a column surface in the periphery of the panel zone (column-beam junction), and the column base portion of the lowest story. For this reason, the main design object of the present design method is tensioning forces of the panel zone, the column base portion, the binding joint portion 6 in the peripheral thereof, and the secondary prestressing tendons 7 and 13.

The PC binding articulation construction method, which is the basis of the present design method, is established on the basis of two theories, namely, fishing rod theory and articulation theory created by the present inventor. The superiority of the PC binding articulation construction method in earthquake resisting performance can be described from these two theories.

[Fishing Rod Theory]

Figure 2A:
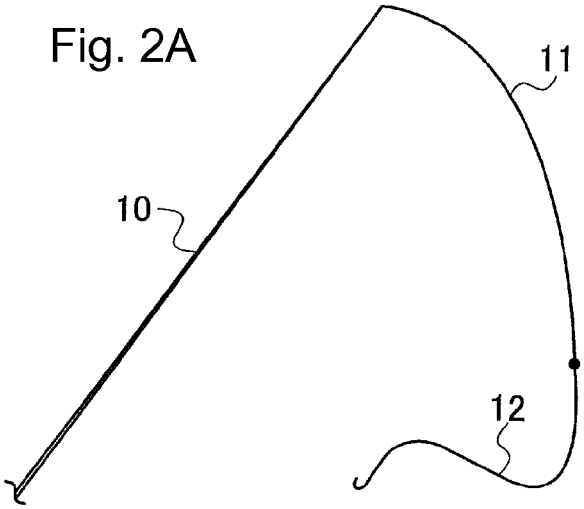
FIGS. 2A and 2B are explanatory drawings illustrating basic principles of the present design method.

In an actual fishing rig tackle, as illustrated in FIG. 2A, in the case where a large fish, rubbish, or a stone is caught by a fishhook, an attempt to made to pull them forcibly may break an expensive fishing rod 10, or a fishing line 11. In order to avoid the fishing rod 10 and the fishing line 11 from being damaged, only a snell portion 12 having a fishhook at a distal end thereof is set to be weak. The break of the snell portion 12 prevents the fishing rod 10 and the fishing line 11 from being damaged. In this theory, the fishing rod 10 corresponds to the column 2 in the rigid frame structure, the fishing line 11 corresponds to the beam 3, and the snell portion 12 corresponds to the binding joint portion 6, which is the jointing portion at an end of the beam 3 placed on the cogging 4. Namely, the binding joint portion 6, corresponding to the fragile snell portion 12, suffers damage firstly.

[Articulation Theory]

Figure 2B:
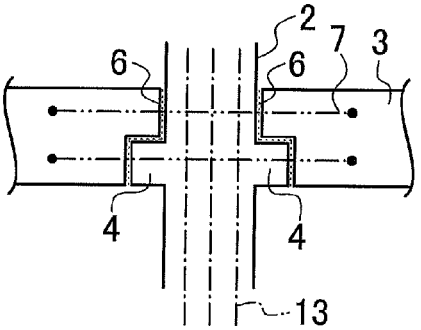

An articulation of human being is a connection of a bone and a bone, configured to be rotatable at the articulation portion. A connecting surface includes a soft cartilage portion, and the bones are connected with strong muscle having sufficient elasticity in the periphery thereof. With such a structure, when he falls or hits against something, an impact can be reduced or absorbed. In this theory, the column-beam junction, as illustrated in FIG. 2B, works like the articulation of human being. In the PC binding articulation construction method, the binding joint portion 6, which is a jointing portion of the beam 3 placed on the cogging 4, corresponds to the articulation, and the prestressing tendon 7 corresponds to the elastic muscle of human being, which connects the bones.

In order to solve the problem relating to the above-described construction earthquake resisting performance, the present design method is on the basis of countermeasures against large earthquakes with a resilient design by a prestressed concrete construction using properties of the prestressing tendon.

By applying these two theories to the binding joint portion 6 between the column 2 and the beam 3, which are construction members, the PC construction may be provided with quite superior earthquake resisting performance and, in addition, an economical design is enabled.

With RC structure, S structure, and SRC structure of the related art, buildings are significantly deformed (an inter-story deflection angle of approximately 1/100) by an earthquake with a seismic intensity 6 lower or so, and thereby the members are damaged or collapsed so that restoration is impossible.

The present design method is based on the resilient design such that internal energy, accumulated in a concrete member by the prestress applied in advanced, is used for counteracting the earthquakes with a seismic intensity 6 lower or so. The construction itself is resiliently deformed. This reduces significantly the inter-story deflection angle (to approximately 1/150), as compared with the RC construction. A state of full prestress is maintained. The building stays in a good condition after the earthquake disaster.

In contrast, a maximum earthquake larger than that described above is handled by that the construction itself is also the resilient design, but the binding joint portion 6 partly produces a partial prestress effect. In a word, the building suffers no damage even in the maximum earthquake. This is an important design condition and characteristic of the present design method.

The partial prestress effect means that the binding joint portion 6 opens once by an earthquakes input, and the opening closes again by a PC restoration force after the earthquakes has gone.

The reason why the inter-story deflection angle is suppressed to smaller than the building of the related art, such as the RC structure or the SRC structure, when the earthquake load of the same level is applied is that the deformation of the PC construction is resisted by the internal energy accumulated in the PC member, the PC restoration force (vibration control effect) of the column, and the column-beam tightening effect. For example, in the case of the earthquake with a seismic intensity 6 lower or so, a plastic deformation with an inter-story deflection angle of approximately 1/100 or larger occurs in the RC structure and the SRC structure. However, in the PC construction of the present design method, the inter-story deflection angle is up to approximately 1/150, and the amount of deformation is significantly reduced in comparison with the RC structure. The value of the inter-story deflection angle varies not only depending on a construction form, but also on various conditions such as the scale, shape, height of the building and ground. Therefore, the values described above are only reference values for design.

Since there is no accurate (strict) conversion between the inter-story deflection angle and the seismic intensity, the inter-story deflection angle in the present design method is a design value as a rough standard, and the indicated values include the meaning such as "about," "roughly speaking," "substantially," or "approximately."

The present design method on the basis of the theories described above is performed so as to satisfy the following requirements:

No column failure preceding type destruction occurs;

No great beam failure preceding type destruction occurs;

The great beam does not drop even though the construction is significantly deformed due to the earthquake force;

The great beam is allowed to rotate without slippage downward on the cogging of the column;

A binding force of the binding junction is set so that a state of full prestress is maintained up to a seismic intensity 6 lower, or the inter-story deflection angle of 1/150 or so; and At the time of maximum earthquake with a seismic intensity 6 upper or greater, or the inter-story deflection angle from 1/150 to 1/100, the binding joint portion becomes a state of partial prestress, and the structural joint portion between the column and the beam on the cogging opens (or separates), becomes rotatable, and thereby absorbs energy.

The destruction of the panel zone (column-beam junction) is controlled by the column and the beam opening on the cogging. Thereby the panel zone suffers no damage. Axial compressions are added three-dimensionally to the panel zone, which thereby has a restoration force characteristics by the prestress. This prevents residual deformation after the earthquakes perfectly. This is a completely different design idea from that of the related art, in which the destruction of the panel zone in the RC construction and the PC construction absorbs energy.

Confirmed from a number of experiments, when the column-beam junction of the present design method is deformed up to a predetermined earthquake load design value (in the experiments, an inter-story deflection angle of 1/100) in a state of full prestress, small cracks are formed above and below the panel zone. When the amount of deformation becomes higher than the design value, the binding joint portion between the column and the beam on the cogging becomes in a state of partial prestress, opens (or separates), and becomes rotatable. It was verified that this makes the small cracks above and below the panel zone close inversely. Accordingly, no further cracks occur in the panel zone.

In the RC construction of the related art, energy of the earthquake is absorbed by a plastic deformation of the panel zone at the time of large earthquake (seismic intensity 6 lower or greater). As a result, the panel zone is subjected to shear failure. This makes the construction in collapse, which is a so-called column failure preceding type. In contrast, in the column-beam binding junction of the PC construction of the present design method, the binding joint does not separate up to a predetermined earthquake load design value. However, at the time of the maximum earthquake, in which the load exceeds the design value, the panel zone is prevented from being subjected to shear failure by separating the binding joint. Finally, the binding joint portion 6 may be subjected to light damage by the rotation. However, since the great beam 3 is on the cogging 4 and coupled by the prestressing wire (the prestressing tendon) 7, which is wired and tensed as the secondary cable, the great beam 3 does not drop from the cogging 4. The tensioning force of the secondary cable penetrating through the panel zone is set to 50% or so of the standard yield load of the prestressing tendon 7 in the binding junction. This may produce margin (available capacity) in tensile performance, and thereby may make the restoration force after the deformation maintained. These experiments prove a superior earthquake resisting performance according to the present design method.

As regards the rotation of the binding junction of the present design method, a juncture state between the beam 3 and the column 2 is controlled by setting properly the amount of the prestressing tendons 7 arranged on the great beam and penetrating through the panel zone, and tensile force applied to the prestressing tendons 7. In the binding junction, the tensioning force of the prestressing tendon 7 is within a range from 40% to 60%, preferably 50%, of a standard yield load (Py) of the prestressing tendon 7.

At the time of permanent load, or medium and small earthquakes, a state of rigid connection is maintained, in which no rotation occurs, and a resilient stress of the PC construction tackles and controls the load. Design is made to be a state of full prestress up to the seismic intensity 6 lower (an inter-story deflection angle of 1/150). Only when there occurs the maximum earthquake greater than that, the junction between the column 2 and the beam 3 becomes a juncture state of partial prestress, allows rotation, and the binding joint portion 6 starts to separate. Even in this state, the prestressing tendon 7 has a sufficient available capacity, and is within the resilient range. Thus, no fracture (plastic deformation) occurs in the prestressing tendon 7. When the earthquake is gone, the opening closes again by the PC restoration force, and the rotated binding junction (binding joint portion) is restored to the original state. When the separation of the binding joint portion 6 occurs, the prestressing tendon 7 bonded to the grout in the sheath 8 partly comes out, and the bond is broken. This breakage of bond generates a damper effect. Namely, the prestressing wire comes out, an expansion of the prestressing wire increases, and thereby the energy is absorbed. With this effect, an input value at the time of the maximum earthquake is reduced and restrained. Thereby energy of the destruction load caused by earthquake entering the construction having the damper effect is absorbed, and the input load is kept to be a small value.

In the present design method, a load corresponding to an earthquake with a seismic intensity 6 lower (up to an inter-story deflection angle of 1/150) is set to the predetermined earthquake load design value. Design is made to make the construction members and the joint portion to be a state of full prestress at the time of the earthquake or smaller. At the time of a maximum earthquake larger than that, that is, when occurs an earthquake with a seismic intensity 6 upper or greater (an inter-story deflection angle from 1/150 to 1/100), the construction members remain in a state of full prestress, and the joint portion becomes in a state of partial prestress.

Figure 3:
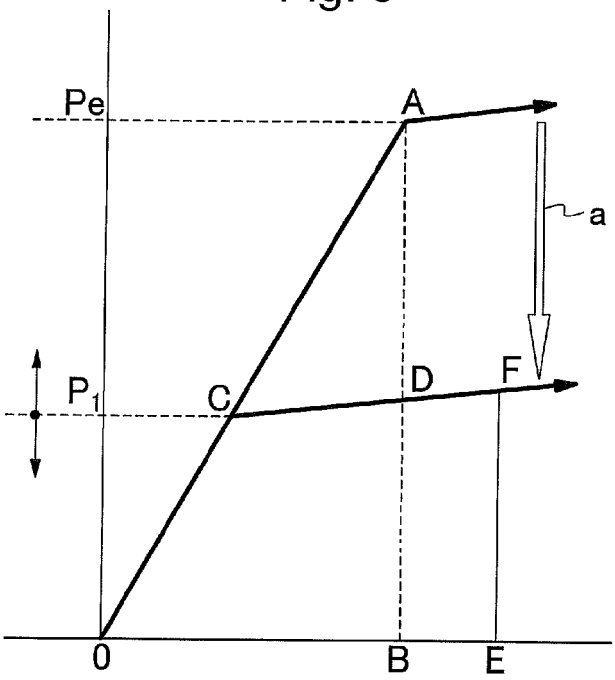
FIG. 3 is a conceptual drawing of energy absorption of the present design method.

Referring to FIG. 3, a concept of energy absorption of the present design method will be described in detail.

The line segment OA in the figure is a resilient deformation line of the prestressing tendon 7, while the point A corresponds to a resilient deformation limit value Pe of the prestressing tendon 7. Within this area, a load-deformation relationship of the member is linear. If a tensile force applied to the prestressing tendon 7 exceeds the resilient deformation limit value Pe, the tensile force increases little, and the prestressing tendon 7 is broken soon. A surface area of the triangle 0AB shows an energy absorbed by the prestressing tendon 7. The PC construction of the related art has such an energy consumption history characteristic. The problem thereof is that an amount of deformation is small for a high input value. If the tensile force exceeds the resilient deformation limit value, the prestressing tendon 7 is at risk for breakage, since the expansion of the prestressing tendon 7 is small.

The present design method is based on a resilient design so as to avoid the yield of the prestressing tendon 7. A design value $P_1$ is a threshold value between an area of full prestress and an area of partial prestress. The design value P1 is set to an input value corresponding to an earthquake with a seismic intensity 6 lower (up to an inter-story deflection angle of 1/150). Up to this, a first stage is designed as to make the entire frame in a state of full prestress, in which the binding joint portion 6 does not open (gap). Therefore, the first stage is a linear resilient design as indicated by line segment 0C.

Subsequently, a second stage is designed as to make the bond between the prestressing tendon 7 and the grout in the sheath 8 to break within a required range of length in the vicinity of the binding juncture surface, whereby the prestressing tendon 7 comes out, in the case where occurs a maximum earthquake with a seismic intensity 6 upper or greater, or an inter-story deflection angle of 1/150 or larger. Since the amount of expansion (an amount of deformation of separation of the joint) of the prestressing tendon 7 increases, the input load decreases as indicated by the arrow a, the binding joint portion 6 opens, the rotation due to the separation occurs, and the juncture state becomes partial prestress. Therefore, the second stage is a linear resilient design as indicated by the line segment CF.

Consequently, a load-deformation relationship of the member becomes non-linear, indicated by the polygonal line 0CF connected the line segment 0C, which indicates the linear resilient design of the first stage, and the line segment CF, which indicates the linear resilient design of the second stage. Past the point C, corresponding to the design value $P_1$, a gradient of the load-deformation curve declines, or the curve becomes shelving toward a lateral axis direction (horizontal axis direction). This makes the input value at the point F, where a surface area of the triangle CAD is equal to a surface area of the tetragon BDFE, is not much higher than the point C. Thus, the member is not at risk for breakage at all, even when absorbing the same energy as that indicated by the triangle 0AB. When occurs an earthquake in which the load exceeds the design value, the breakage of bond makes the prestressing tendon 7 come out, and thereby the amount of expansion thereof increases. The beam 3 rotates on the cogging 4 of the column 2, whereby the earthquake energy is absorbed, and the input value decreases. This prevents principal construction members (column 2, beam 3, and panel zone) from being damaged. The prestressing tendon 7 has a sufficient available capacity, because the tensile force is 50% or so of the standard yield load Py. Therefore, the prestressing tendon 7 remains within a resilient range, suffers no plastic deformation, and keeps the restoration force, all the way. After the earthquake, the residual energy makes the opening close, and thereby the separated joint is restored to its original state, that is, an original point restoration is achieved. This is an important design point.

In the present design method, when occurs the maximum earthquake in which the load exceeds the predetermined design value the binding joint portion 6 opens or separates, and allows rotation, whereby a state of partial prestress is achieved locally (that is, at the binding joint portion 6). The predetermined design value is set to be a value corresponding to an earthquake with a seismic intensity 6 lower (inter-story deflection angle of 1/150), for example. It may be a value corresponding to an inter-story deflection angle of 1/100. Also it may be a value corresponding to an inter-story deflection angle of 1/50, depending on conditions, such as the scale, the floor height, and the shape of the building, and the arrangement of the construction members.

Since the design provides the prestressing tendon 7 with a sufficient available capacity, the prestressing tendon 7 remains within the resilient range at all way, whereby the building itself has a structure performance of restoring to the original state by the resilient restoration force after the earthquake.

In other words, the prestressing tendon 7 is disposed with tension in a state of prestress having an available capacity. The tensioning force is accumulated in concrete as an internal energy, and the earthquake energy is absorbed by the available capacity. Consequently, even though occurs the earthquakes in which the load exceeds the predetermined design value, the building structure can be protected by the binding joint portion 6 opening. Even though the binding joint portion 6 is subjected to light damage, such damage can be repaired easily. So, the entire building can be continuously used in a good condition after the earthquake. Even though afterquakes occur, or a maximum earthquake occurs again, the same thing is repeated, since the building keeps the superior earthquake resisting performance. Therefore, the present design method is completely different from the earthquake resisting design method which allows damages (plastic deformation) of the construction with the seismic intensity 5 upper or so of the related art.

Figure 4:
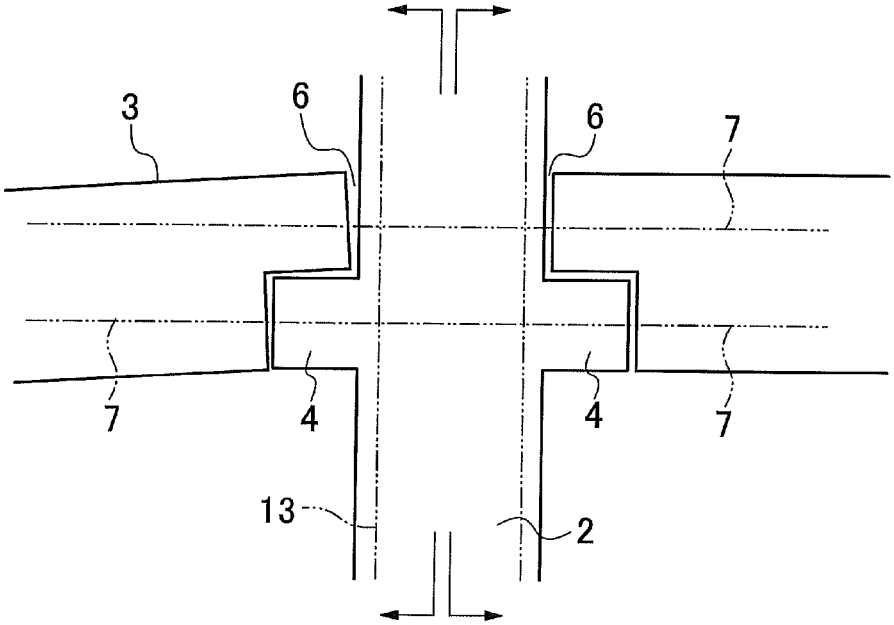
FIG. 4 is an explanatory drawing illustrating a state of a PC binding juncture of the present design method.

Referring to FIG. 4, which illustrates the state of the PC binding juncture, the juncture state of partial prestress will be described. The right side of the figure shows a juncture state of full prestress, and the left side thereof shows a juncture state of partial prestress in the PC binding juncture between the column 2 and the beam 3. In the present design method, the secondary prestressing tendon 13 arranged on the column 2 and the prestressing tendon 7, which is a secondary cable, arranged in the beam 3 are of a bonded type, which are grouted in the sheaths disposed in the column 2 and the beam 3. The column-beam binding juncture surface remains in a juncture state of full prestress at the time of an earthquake in which the load does not exceed the predetermined design value (a seismic intensity 6 lower, or an inter-story deflection angle of 1/150). At the time of an earthquake in which the load exceeds the predetermined design value (for example, a seismic intensity 6 upper or greater, or an inter-story deflection angle from 1/150 to 1/100), the bond to the grout is broken, the prestressing tendon 7 comes out, the amount of expansion thereof increases, and thereby the binding joint portion 6 opens. This makes the end portion of the beam 3 on the cogging 4 rotate, and the juncture state becomes partial prestress.

Next, the breakage of bond of the prestressing tendon will be described with reference to FIGS. 5 and 6.

Figure 5A:
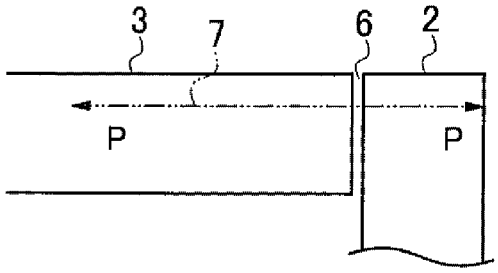
FIGS. 5A and 5B are explanatory drawings illustrating bonding states of a secondary prestressing tendon of the present design method.
Figure 5B:
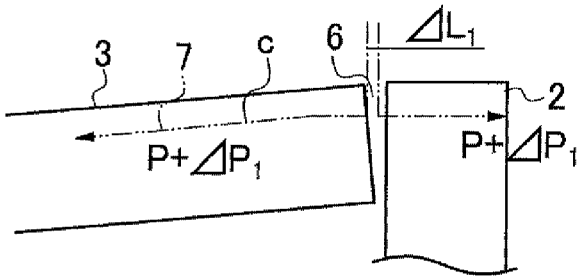

A tensioning force is applied to the prestressing tendon 7, which is the secondary cable, through a fitting and an anchor head. This makes a prestress force introduced into the concrete members. After the tensile fixation is completed, the grout is filled and hardened in the wiring sheath. Thereby prestressing tendon 7 is completely bonded to the grout in the sheath, and propagates a stress to the interior of the concrete members. The prestressing tendon 7 is already stretched by ΔL (not illustrated) caused by the introduced tensioning force P. The prestress force introduced into the members, such as the column 2 and the beam 3, works as compression force in a direction opposite to the tensioning force P on cross sections of the members (not illustrated). FIG. 5A shows the state of the joint in which the prestressing tendon 7 is completely bonded to the grout after the tensile fixation. When the maximum earthquake occurs, the binding joint 6 (the structure joint) opens, and thereby bond between the prestressing tendon 7 and the grout is broken within a range from the binding joint 6 to the position c (a required range of length), as illustrated in FIG. 5B. At this time, the prestressing tendon 7 is additionally stretched by ΔL1. The tensile force of the prestressing tendon 7 becomes P+ΔP1. The amount of expansion ΔL1 of the prestressing tendon 7 is a total (ΔLe+ΔLn) of an amount of expansion ΔLe, purely caused by the resilient deformation of the prestressing tendon 7, and an amount of expansion ΔLn, caused by coming out of the prestressing tendon 7 brought by the breakage of the bond to the grout. Accordingly, the deformation of the binding joint portion 6 increases, the opening opens larger, and separation and rotation arises.

Figure 6:
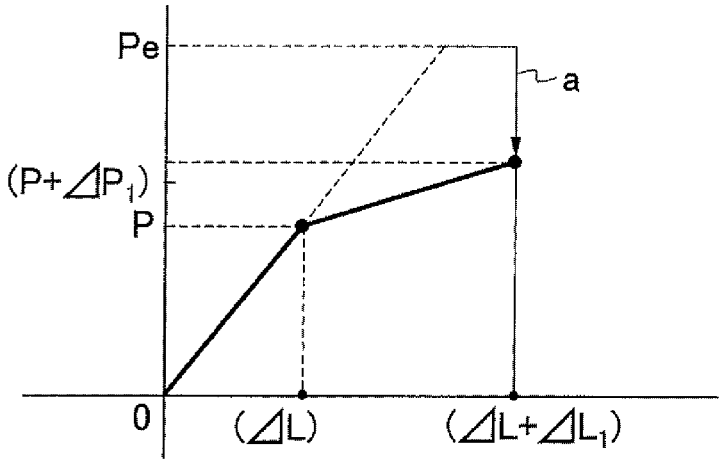
FIG. 6 is a conceptual drawing illustrating a relationship between a load and an expansion when the bond of the secondary prestressing tendon is broken in the present design method.

As illustrated in FIG. 6, with the bond broken, the resilient hysteresis curve, which shows the load-deformation relationship, becomes shelving toward the lateral axis, or its gradient becomes smaller. Increment of the amount of expansion of the prestressing tendon 7 enables absorption of the earthquake energy and decrement of the earthquake input value. The amount of expansion of the prestressing tendon 7 is omitted until the bond is broken, because it is normally very small, although it relates to the deformation of the concrete member. The bond force F is proportional to a bond strength σa and a surface area A of the prestressing tendon, that is, $F \propto \sigma a \times A$.

The surface area A of the prestressing tendon is proportional to a perimeter of the prestressing tendon (cable), which relates to the cross-sectional shape and the number of the cables, and a length of bond. Therefore, adequate adjustment of conditions, such as the strength of the grout, the perimeter of the prestressing tendon, and the length of bond, enables a design in which the magnitude of the maximum bond force is fitted to the design value so that the bond is broken at the predetermined value.

In the present design method, as illustrated in FIG. 6, the binding joint portion 6 remains in the state of full prestress and the prestressing tendon 7 and the grout are completely bonded, under the design value P corresponding to the predetermined earthquake level (seismic intensity 6 lower, or inter-story deflection angle of 1/150). Over the design value P caused by a maximum earthquake occurring, the bond between the prestressing tendon 7 and the grout is broken, the prestressing tendon 7 comes out, the expansion of the prestressing tendon 7 increases, and thereby the energy is absorbed. At this time, the binding joint portion 6 opens or separates, and becomes rotatable, and the state becomes locally partial prestress. The result is that the gradient of the hysteresis characteristic curve between load and expansion becomes smaller, or the curve becomes shelving towards the lateral axis, past the design value P. The input load applied to the construction members does not reach Pe, and slightly increases to $P+\Delta P_1$. The effect of the prestressing tendon coming out can reduce the earthquake input load, as illustrated by an arrow a. When the earthquake has gone, the prestressing tendon, which has come out, is restored to the original position by the resilient restoration force. This is characteristic of the present design method. In the present design method, a non-linear resilient design, which considers a maximum earthquake in which the load exceeds the design value, is applied only to the construction members. A resilient design is applied to the prestressing tendon 7, which is a secondary cable, so that it remains within a linear resilient range over all the entire stages.

The PC construction of the present design method is not only an earthquake resisting structure, but also a seismic vibration control structure. The reasons will be described with reference to FIG. 7.

1. The prestressed concrete is concrete having a force that resists an external force which the construction will be exposed in the future, and that is introduced in the interior of the concrete member.
2. The prestressed concrete is concrete having a defensive system against an external force involved therein, and internal energy accumulated therein, at a stage of manufacturing the member. The internal energy described here is energy generated by a prestress force introduced in the concrete member in advance.

The prestress force is an internal force existing in the interior of the member in advance, and acts always in a direction opposite to the direction of deformation of the member. Since the prestressing tendon is designed to be within the resilient range, the prestress force works as a spring, and becomes a resisting force, when the building is about to be deformed due to the earthquake or the like, to restore the deformed building as a pendulum. This is referred to as a restoration force by the prestress, which is a force to restore the original state at the time of deformation. This effect is referred to as a vibration control effect by the prestress. The vibration control effect can be obtained only in the PC construction.

As regards the beam 3 illustrated in FIG. 7A, since the tensile force is introduced into the prestressing tendon 7 arranged therein, an internal force Ps against an external force P is already embedded therein, thereby lifting the beam 3 so as to eliminate a flexural deformation by the external force P.

As regards the column 2 illustrated in FIG. 7B, since the tensile force is introduced into the prestressing tendon 13, similarly as the beam 3, an internal force Ps generates a resistance moment Mps against an overturning moment Mp caused by a horizontal external force P, thereby eliminating a rotational deformation of the column, and maintaining the original state. In the case that a repeated horizontal force P by the earthquake is applied, the internal force Ps generates the restoration force, the deformation is restrained, and thereby the column 2 is restored to the original state after the earthquake. This is a vibration control effect.

According to the present design method, applying prestress in advance to the prestressing tendon 7 with available capacity enables to check safety of the members and constructions, and to provide the PC construction with the vibration control performance.

At the column base portion, this vibration control effect behaves as follows. When occurs a maximum earthquake in which the load exceeds the predetermined design value, the binding joint portion 6 under the column base opens, and becomes in a state of partial prestress. The binding joint portion opens while the prestressing tendon 13 remains within the resilient range. This achieves absorption of earthquake energy, and prevention of damage and destruction of the columns at the column base portion, which supports the entire building and is the most important. Adequately adjusting an amount of the prestressing tendons 13 and a tensioning force provided for the prestressing tendon 13 enables to maintain the prestressing tendon 13 within the resilient range at all times. Thus, after the earthquake, the PC restoration force makes the opening close again, and thereby the joint is restored to the original state (the juncture state of full prestress). This enables the building to be used continuously. In order to provide the prestressing tendon 13 with a sufficient available capacity, the tensioning force thereof is set to be within a range from 40% to 60%, and preferably to be 50% or so, of a standard yield load of the prestressing tendon 13. The bond between the prestressing tendon and the grout is broken in the vicinity of the binding joint portion, thereby the prestressing tendon comes out, and the amount of expansion increases. This enables to absorb the earthquake energy absorbed, to restrain the tensile force borne by the prestressing tendon, to maintain the prestressing tendon within the resilient range of the prestressing tendon, and to reduce the input value of the maximum earthquake.

In addition, although the illustration is omitted, forming the juncture surface of the binding joint portion into a curved surface is effective to prevent damage of the column base. At the time of the maximum earthquake in which the load exceeds the design value, the joint portion opens, and the column body rotates. This can prevent occurrence of cracking or damage of the column body.

In order to show earthquake resisting performance designed by the present design method, the following table marshals relationship between scales of earthquakes and states of members, which are the design goal of the earthquake resisting level, and deformation of members in the RC or SRC structure of the related art, as a comparative example.

| Scale of Earthquake | Deformation of PC members (Inter-story Deflection Angle) | States of Members according to the Present Design Method | In Case of RC or SRC Structure of Related Art (Inter-story Deflection Angle) |
|---|---|---|---|
| Moderate earthquake | 1/150 (corresponding to seismic intensity 6 lower) | Member: full prestress. Joint portion: full prestress. | 1/100 (Damage of Member or Collapse of Frame Occurs.) |
| Severe earthquake | 1/100 (corresponding to seismic intensity 6 upper or greater) | Member: full prestress. Joint portion: partial prestress. | |
| Maximum credible earthquake | 1/50 (corresponding to seismic intensity 7) | Joint portion: partly collapsed. Prestressing tendon (secondary cable) of the beam: within a resilient range. Beam and column: in good condition. Great beam: remaining on the cogging as single beam. | |
| Earthquake larger than that | 1/25 | Joint portion at beam end: destructed. Column: in good condition. Great beam: still remaining on the cogging as single beam with prestressing tendon (secondary cable). Since the great beam does not drop, human life is not damaged. Building: in good condition. | |

There are few buildings which resist against an earthquake with a seismic intensity 6 upper or greater, in buildings having the RC structure or the like constructed by conventional design methods.

In other words, the RC structure, the SRC structure, and the like are designed to absorb energy at the time of earthquakes of a seismic intensity 6 lower 6 or so, by yielding of reinforcement rods in the great beam portion, and crushing of concrete. Therefore, the building is partly or entirely collapsed.

In contrast, the earthquake resisting structure constructed by the PC binding articulation construction method on the basis of the present design method is designed to absorb earthquake energy on the basis of the fishing rod theory and the articulation theory. A cogging is formed on the column, and the prestress introduced into the construction members is adequately adjusted by the amount of the prestressing tendons penetrating through the panel zone and the tensioning force applied to the prestressing tendon. Thus, when occurs the maximum earthquake with a seismic intensity 6 upper or greater, a joint mortar at the cogging portion separates at upper and lower edges, the great beam rotates on the cogging, and thereby earthquake energy is absorbed. Accordingly, a very superior earthquake resisting structure can be designed and constructed. Since the present design method is the method for designing so as to have the superior earthquake resisting performance, assuming the earthquake one level greater than that assumed in the conventional design method enables to enhance significantly the earthquake resisting level.

In particular, in the PC members in the present design method, the prestress force, which is applied in advance to the column and beam members, works as internal energy, and the PC vibration control effect restrains deformation. Thus, the deformation is smaller than that of the structure, such as the RC structure or the SRC structure, of the related art against the same level earthquake.

Figure 9:
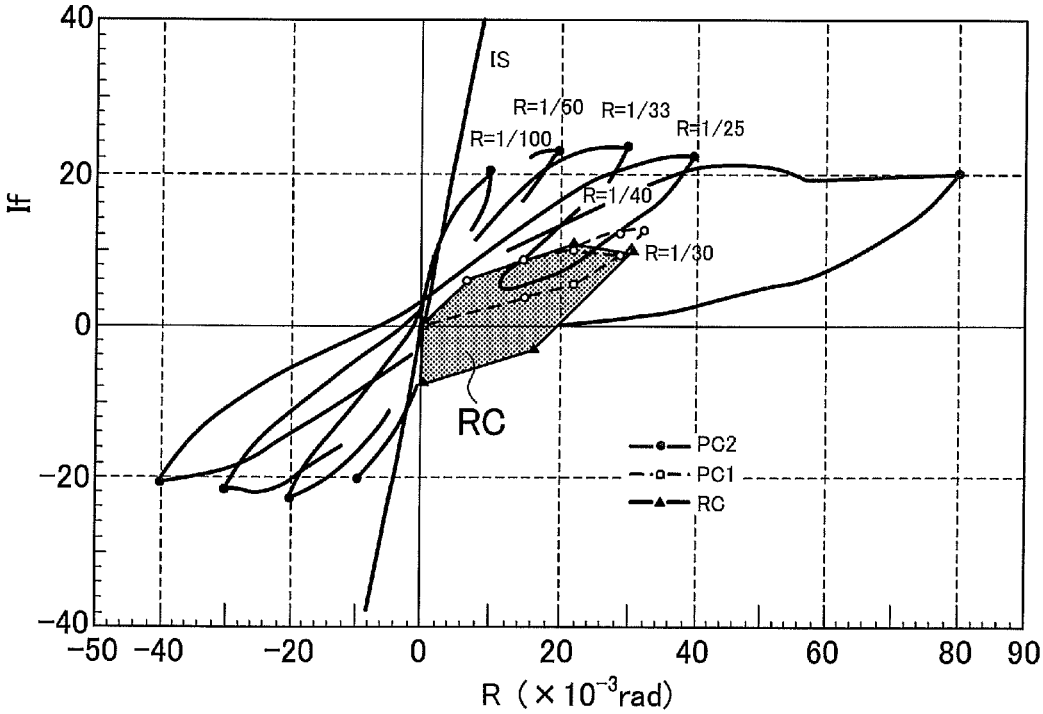
FIG. 9 is a graph chart illustrating a result of experiments using the earthquake resistance test sample and a construction of the related art.

In addition, an experimental verification was conducted on earthquake resisting performances of the column-beam junction used by the present design method. FIGS. 8A to 8C show shapes of a test sample and arrangement of rods thereof. FIG. 9 shows a test result thereof and a test result of the construction of the related art together. The test sample has a ⅓ scale of an actual size, and is a crisscross frame cut out at centers of a floor height and a span form an assumed building. The column and the beams are precast members, and the PC strands (cables) are penetrated through the beams, and thereby the column and the beams are joined by binding juncture.

In FIG. 9, the horizontal axis indicates an inter-story deflection angle R, and the vertical axis indicates a story shear force If, where IS shows an initial rigidity, RC shows an RC construction, PC1 shows PCaPC (steel bar) without cogging, and PC2 shows PCaPC (strand) with cogging.

In the inter-story deflection angle relationship, the binding junction (the articulation portion) separates at the point that the tensile force acts on the same level as the fixation force introduced into the PC strand, and thereby the rigidity declines. Past the point, the rigidity decreases gradually with increasing load. Over R=1/66 rad, the bearing force increases a little. Until the application of the force was terminated at R=1/25 rad, no abrupt decrease occurred in the bearing force. By retaining the fixation force introduced into the PC strand to 50% or so of the standard yield load, the restoration force characteristics became of an inverted S-shaped and origin-oriented type having the secondary gradient zone, which is a zone after the binding junction (the articulation portion) separates, longer than that of the conventional PC construction without cogging. The residual inter-story deflection was quite small, and was 1/1000 rad or so until R=1/50 rad. A tendency of extremely high restorability is observed.

In contrast, the RC construction yields and proceeds to destruction against input earthquake motions significantly smaller than the PC construction of the present design method, as shown in this graph.

From the experiment result, following findings were obtained.

1. The larger the member deformation angle is, the more broadly the binding joint portion opens. However, few cracks occur in the beam, the column, and the panel zone.
2. When the member deformation angle is large, a great beam rotates while its end is on the cogging. However, the great beam 3 has no risk for drop, because it is connected to the adjacent beam 3 through the column 2 with the prestressing tendon 7, which is the secondary cable.
3. Articulational rotation at the end of the beam prevents the members (the great beam and the column) from being damaged even though the member deformation angle is large.

Based on the findings, the following design can be performed in the present design method. The load corresponding to the earthquake with a seismic intensity 6 lower (up to an inter-story deflection angle of 1/150) is set to be the predetermined earthquake load design value. When occurs an earthquake smaller than that, the member and the binding joint portion 6 are kept in a state of full prestress. When occurs a maximum earthquake with a seismic intensity 6upper or greater (an inter-story deflection angle from 1/150 to 1/100), the member remains in the state of full prestress, while the joint portion is brought into a state of partial prestress. In addition, even when occurs a maximum earthquake with a seismic intensity 7 (an inter-story deflection angle from 1/100 to 1/50), only the joint portion suffers a partial and light damage, while the panel zone and the column 2 and the beam 3 are kept in good conditions.

In a word, the tensioning force to be introduced into the prestressing tendon 7, which is the secondary cable used for joining the column 2 and the beam 3, which are the construction members, with binding articulation juncture, is set to be 50% or so of the standard yield load. This enables to maintain the construction member (frame) in no-damage condition even at the time of the extremely large earthquake. Research of the PC binding articulation construction method is systematically proceeded, and it is confirmed that little residual plastic deformation occurs, and the restoration force characteristics is stable, even when the inter-story deflection angle reaches 1/50 rad or so.

Subsequently, comparison in damage between the RC constructions and the PC construction of the present design method will be described with reference to FIG. 10.

Figure 10:
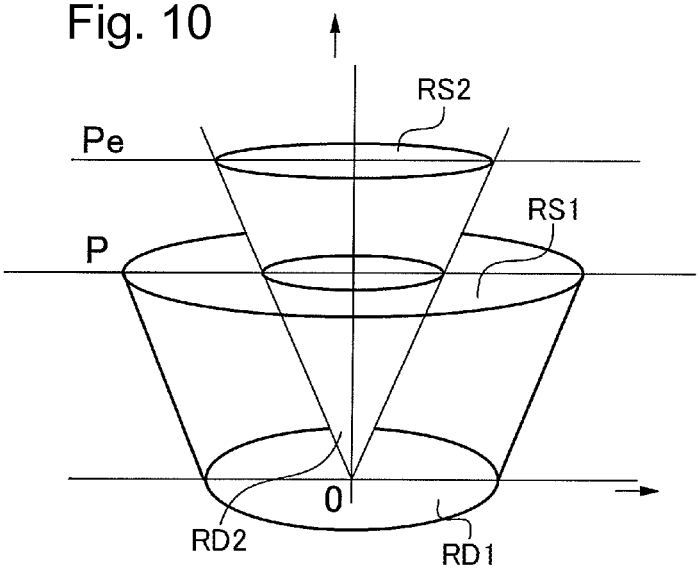
FIG. 10 is a conceptual drawing illustrating stresses input into constructions, and shaking widths and amounts of residual deformation at the time of earthquake, in a PC construction of the present design method and an RC construction of the related art.

FIG. 10 is a conceptual drawing illustrating stresses input to the both constructions and amounts of residual deformation at the time of an earthquake. The vertical axis indicates the stress, and the horizontal axis indicates the amount of residual deformation, where RS 1 shows a shaking width of the RC construction, RD1 shows the amount of residual deformation of the RC construction, RS2 shows a shaking width of the PC construction according to the present design, and RD2 shows the amount of residual deformation of the PC construction according to the present design.

The RC construction is configured to absorb energy by being resiliently deformed up to a certain amount of stress, and by being plastically deformed over the amount. This results in not only increasing the residual deformation, but also doubling the load of the construction because resonance amplifies the shaking at the time of an earthquake, which we have learned actually from a bridge support collapse accident of Hanshin Expressway No. 3 Kobe Route in the case of the Great Hanshin-Awaji Earthquake. As a matter of course, this progresses and doubles the plastic deformation, and results in collapse.

In the PC construction of the present design method, the prestressing tendon shows a behavior within the resilient deformation up to a large stress, and makes an attempt to restore to the original point. Energy at the time of the earthquake is absorbed by the expansion of the prestressing tendon within the resilient deformation by an internally existing function, that is, the internal energy accumulated in the construction itself. Vibration control effect of the PC construction makes the shaking width significantly smaller than the RC construction. At the time of the maximum earthquake, in which the load exceeds the design value, a damper effect is produced, in which the joint portion opens, the beam rotates on the cogging, the state becomes partial prestress, and energy is absorbed by expansion of the prestressing tendon in the vicinity of the binding joint portion, where the bond is broken. After the earthquake has ended, the property is shown, in which the prestressing tendon are restored to the original state as the resilient member, and the binding joint portion closes the opening by the restoration force of the PC construction, and the construction is restored to be the original state.

As described above, in the present design method, the amount of the prestressing tendons, which are the secondary cables, arranged in the great beam and penetrating through the panel zone and a tension force to be applied to the prestressing tendons are adjusted adequately, the juncture state between the beam and the column is controlled, and thereby the predetermined earthquake load value is set to a load corresponding to the earthquake with a seismic intensity 6 lower (up to an inter-story deflection angle of 1/150).

The internal energy accumulated in the concrete member by the prestress provided in advance is used as a resisting force, and the member and the joint portion are designed to be in a state of full prestress. This prevents all construction members from being damaged with the present design method, even at the time of the earthquake when the RC constructions and the SRC constructions constructed by the conventional design method are significantly subjected to plastic deformation (an inter-story deflection angle of 1/100 or larger), the members are damaged and destructed, and restoration after the earthquake is almost impossible.

The design is made so that the member remains in the state of full prestress, and the joint portion becomes in the state of partial prestress, when occurs the maximum earthquake with a seismic intensity 6 upper or greater (an inter-story deflection angle of 1/150 to 1/100). In addition, even when occurs the maximum earthquake corresponding to a seismic intensity 7 (an inter-story deflection angle from 1/100 to 1/50), the PC constructions of the present design method is slightly damaged only at part of the joint portion. Thus, the panel zone, the beam, and the column can be maintained in a state of no damage.

The PC seismic isolation construction, which is a combination of the present design method and the seismic isolation construction method, has higher rigidity than the construction where the superstructure is the S structure, and can restrain the vibrations to be smaller. Since the PC construction itself has the vibration control effect by the restoration force, a vibration control damper need not be used with the seismic isolation apparatus. Therefore, the cost can be significantly reduced, in comparison with the construction where the superstructure is the RC structure or the SRC structure.

The concept and the basic design condition of the present design method have been described. A rational change is possible according to the various design conditions of the building without departing from the drift of the present design method.

For example, the design value of the inter-story deflection angle is an approximate value to be referenced as a guide depending on the scale of the earthquake (seismic intensity). In a practical design, it is preferably determined by rational adjustments depending on the design conditions, such as the scale, shape, and height of the building, and the conditions of the ground. Instead of using the inter-story deflection angle as a design value of deformation, a member deformation angle, or a rotational angle (an angle formed between the beam end and the column surface) may be used. In this case, these values may be properly set in accordance with the designing drift of the present design method.

The strength Fc of the high-strength concrete used in the present design method is not smaller than 40 $N/mm^2$, and preferably not smaller than 50 $N/mm^2$.

In addition, the prestressing tendon is the same as conventionally used. Detailed design of the respective PC members, while the description is omitted, can be performed in a similar way as conventional design.

Illustration of the concept and the image is models expressing the design idea and the basic concept, and is expressed in a simple manner.

An earthquake resisting design method on the basis of a PC binding articulation construction method according to the present invention is an earthquake resisting design method for the PC construction. The PC construction is a building having a rigid frame structure, having a plurality of floors, and having a foundation, a column, and a beam. The column and the beam are high-strength precast prestressed concrete members. A cogging is provided on the column. The beam is placed on the cogging. A binding joint portion is provided therebetween. A secondary cable is provided on the beam, and penetrates through a panel zone (column-beam junction). The secondary cable integrally joins the column and the beam integrally by binding juncture. The earthquake resisting design method includes: controlling a tensioning force of a prestressing tendon as the secondary cable in a binding junction (binding joint portion) between the column and the beam; thereby providing a first stage linear resilient design where a juncture state remains full prestress, and any constructions are not allowed to be damaged, up to a predetermined earthquake load design value; and providing a second stage linear resilient design, where the binding junction between the column and the beam becomes in a juncture state of partial prestress, the binding joint opens or separates and allows rotation, a bond between the prestressing tendon and a grout is broken within a required length in vicinity of the binding joint, the prestressing tendon comes out, the amount of expansion of the prestressing tendon increases, and thereby the prestressing tendon absorbs earthquake energy, while a tensile force applied to the prestressing tendon hardly increases, the prestressing tendon remains within the linear resilient area, and primary construction members (the column, the beam, and the panel zone) are not allowed to be damaged, when encountering a maximum earthquake exceeding the predetermined earthquake load design value, and a non-linear resilient design for the PC construction is achieved, which is separated to two stages, which are the first stage and the second stage. Therefore, in the first stage, the construction itself is resiliently deformed so that all of the construction members are prevented from being damaged, and the state of full prestress is maintained, and thereby the building is in good conditions and can be used continuously without losing functions as the building after the earthquake disaster. And in the second stage, even when the maximum earthquake occurs exceeding the predetermined design value, the joint portion opens and is lightly damaged only partly, and thereby the panel zone, the beam, and the column can be protected to a non-damaged state. Thus, the method can be applied widely to the buildings having the PC constructions.

What is claimed is:

1. An earthquake resisting design method on the basis of a prestressed concrete (PC) binding articulation construction method, for a PC construction which is a building having a rigid frame structure, having a plurality of floors, and having a foundation, a column, and a beam, the column and the beam being high-strength precast prestressed concrete members, a cogging being provided on the column, the beam being placed on the cogging, a binding joint portion being provided therebetween, a cable being provided on the beam, and penetrating through a panel zone or a column-beam junction, and the cable integrally joining the column and the beam by binding juncture, the earthquake resisting design method comprising:

designing a prestressing tendon as the cable, the prestressing tendon being inserted through each of sheaths disposed in the column and the beam and being tensed and fixed, and a grout being filled and bonded to the prestressing tendon in each sheath;

controlling a tensioning force of the prestressing tendon as the cable in a binding junction or a binding joint portion between the column and the beam;

thereby providing a first stage linear resilient design, where a juncture state remains full prestress, and any constructions are not allowed to be damaged, up to a predetermined earthquake load design value; and providing a second stage linear resilient design, where the binding junction or binding joint portion between the column and the beam becomes in a juncture state of partial prestress, the binding joint portion opens or separates and allows rotation, a bond between the prestressing tendon and the bonded grout in each sheath is broken within a required length in the vicinity of the binding joint portion, the prestressing tendon comes out, an amount of expansion of the prestressing tendon increases, and thereby the prestressing tendon absorbs earthquake energy, while a tensile force applied to the prestressing tendon hardly increases, the prestressing tendon remains within the linear resilient area, and principal construction members are not allowed to be damaged, when encountering a maximum earthquake exceeding the predetermined earthquake load design value, and wherein a non-linear resilient design for the PC construction is achieved, which is separated to two stages, which are the first stage and the second stage.

2. The earthquake resisting design method on the basis of the PC binding articulation construction method according to claim 1, wherein the predetermined earthquake load design value of the first stage corresponds to earthquakes up to a seismic intensity 6 lower, and the maximum earthquake of the second stage corresponds to earthquakes having a seismic intensity 6 upper or greater.

3. The earthquake resisting design method on the basis of the PC binding articulation construction method according to claim 1, wherein a tensioning force of the prestressing tendon as the cable in the binding junction or the binding joint portion of the column and the beam is 40 to 60% of a standard yield load of the prestressing tendon.

4. The earthquake resisting design method on the basis of the PC binding articulation construction method according to claim 1, wherein the binding joint portion is provided between the foundation and a column base of the column, a secondary prestressing tendon is provided on the column, and penetrates through the foundation and the column base, the secondary prestressing tendon integrally joins the foundation and the column by binding juncture, in a column base portion formed by the integrally joined foundation and column, a juncture state remains full prestress, and all contractions are not allowed to be damaged, up to the predetermined earthquake load design value in the first stage, the binding joint portion opens, separates, and becomes partial prestress, the prestressing tendon is maintained within a resilient range, thereby the earthquake energy is absorbed, and the column is not allowed to be damaged, in the case where the maximum earthquake occurs exceeding the predetermined earthquake load design value in the second stage.

5. The earthquake resisting design method on the basis of the PC binding articulation construction method according to claim 4, wherein a base block is installed as the column base between the foundation and the column.

6. The earthquake resisting design method on the basis of the PC binding articulation construction method according to claim 4, wherein a tensioning force of the secondary prestressing tendon is 40 to 60% of a standard yield load of the prestressing tendon in the binding joint portion of the column base portion.

7. The earthquake resisting design method on the basis of the PC binding articulation construction method according to claim 1, wherein the PC construction includes a PC seismic isolation construction combined with a seismic isolation construction method.

8. An earthquake resisting building built by the PC binding articulation construction method constructed on the basis of the earthquake resisting design method according to claim 1.

* * * * *